US007810480B2

(12) United States Patent
Shepley et al.

(10) Patent No.: US 7,810,480 B2
(45) Date of Patent: Oct. 12, 2010

(54) CROSSBOW ACCESSORY FOR LOWER RECEIVER OF RIFLE AND RELATED METHOD

(75) Inventors: Paul Edwin Shepley, Tucson, AZ (US); Kevin Hansen, Tucson, AZ (US); Allen C. Rasor, Marana, AZ (US); David H. Kronengold, Tucson, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 151 days.

(21) Appl. No.: 12/350,106

(22) Filed: Jan. 7, 2009

(65) Prior Publication Data

US 2010/0170486 A1 Jul. 8, 2010

(51) Int. Cl.
*F41B 5/12* (2006.01)

(52) U.S. Cl. ..... 124/25

(58) Field of Classification Search ..... 124/25, 124/35.1, 35.2

See application file for complete search history.

(56) References Cited

U.S. PATENT DOCUMENTS

| | | | | | |
|---|---|---|---|---|---|
| 3,483,857 | A | * | 12/1969 | Jones | 124/25 |
| 3,581,729 | A | * | 6/1971 | Jones | 124/25 |
| 3,922,795 | A | * | 12/1975 | Bettencourt | 42/136 |
| 4,030,473 | A | * | 6/1977 | Puryear | 124/35.1 |
| 4,603,676 | A | | 8/1986 | Luoma | |
| 5,598,829 | A | | 2/1997 | Bednar | |
| 5,680,724 | A | | 10/1997 | Peterken | |
| 5,823,172 | A | | 10/1998 | Suggitt | |
| 6,095,128 | A | | 8/2000 | Bednar | |
| 6,286,496 | B1 | | 9/2001 | Bednar | |
| 6,425,386 | B1 | | 7/2002 | Adkins | |
| 6,705,304 | B1 | | 3/2004 | Pauluhn | |
| 6,722,072 | B1 | | 4/2004 | McCormick | |
| 6,874,491 | B2 | | 4/2005 | Bednar | |
| 6,913,007 | B2 | | 7/2005 | Bednar | |
| 6,925,744 | B2 | | 8/2005 | Kincel | |
| 7,100,590 | B2 | | 9/2006 | Chang | |
| 7,168,424 | B1 | | 1/2007 | Wing | |
| 7,363,740 | B2 | | 4/2008 | Kincel | |
| 2005/0022799 | A1 | | 2/2005 | Bednar | |

OTHER PUBLICATIONS

2007 Owner's Manual, "Stryker", Stryker Manufacturing, 10 pages, Eugene, Oregon, (published in 2007).

* cited by examiner

*Primary Examiner*—John Ricci
(74) *Attorney, Agent, or Firm*—Cahill Glazer PLC

(57) ABSTRACT

A crossbow accessory for coupling to a modular lower receiver of a rifle includes an elongated frame coupled to a riser at a first end, and coupled above the lower receiver at its second end. An upper housing secured to the second end of the frame includes a rope spool and winding gears for retracting the bowstring toward a drawn position. A rope extends from the rope spool to a bowstring release for retracting the bowstring. The bowstring release is retracted into the upper housing proximate the modular lower receiver for selectively releasing the bowstring when a user pulls the trigger of the lower receiver. A method for creating a crossbow using the modular lower receiver is also disclosed.

25 Claims, 11 Drawing Sheets

CROSSBOW ACCESSORY FOR LOWER RECEIVER OF RIFLE AND RELATED METHOD

CROSS-REFERENCE TO RELATED APPLICATIONS

The present application is related to a co-pending application Ser. No. 12/350,123, filed concurrently herewith, and entitled "Release Assembly for Crossbow", assigned to the assignee of the present application.

The present application is related to a co-pending application Ser. No. 12/350,131, filed concurrently herewith, and entitled "Compact Winding Mechanism for Crossbow", assigned to the assignee of the present application.

BACKGROUND OF THE INVENTION

1. Field of the Invention

The present invention relates generally to crossbows, and more specifically, to a crossbow accessory used in conjunction with the lower receiver of a modular rifle.

2. Description of the Related Art

One of the most popular sporting rifles in the U.S. and many other parts of the world is the AR-15 rifle. The term "AR-15" was originally an abbreviation for the Armalite Model 15, a semi-automatic rifle that is commercially available to civilians. While the term "AR-15" has been used as a trademark by Colt, generic rifles that use the original AR-15 configuration are available from a large number of manufacturers. The AR-15 civilian semi-automatic rifle and the M4 military automatic rifle are built upon the same basic platform. Among the reasons that the AR-15 is so popular is that it is modular in design, and therefore highly configurable and customizable. There are many suppliers who sell accessory items to add to AR-15 style rifles, including telescopic sights, buttstocks, grips, and the like. In addition, the accuracy of the AR-15 has made it popular with sport shooters and hunters. In particular, the trigger assembly of the AR-15 rifle has proved to be highly reliable in the field. The number of such AR-15 style rifles that have been sold in the U.S. has been estimated at 8 to 12 million. Owners of such rifles are constantly on the look-out for new accessories to use with such rifles.

Crossbows have also long been known in the archery field for use in hunting game. Crossbows have higher draw weights than conventional archery bows and fire arrows (or "bolts") with greater speeds. As a result, crossbows usually have greater range than an archery bow. While there are some hunters own both a rifle and a crossbow, experienced hunters accustomed to hunting with rifles do not often branch into the use of crossbows, perhaps because they perceive that crossbows are too complex to operate.

When crossbows are configured for firing, the force exerted by the retracted bowstring can be in the range of approximately 100 to 200 pounds. The trigger assembly of the crossbow must be capable of holding the bowstring in firing position, while allowing the bowstring to be released as the user pulls the trigger. This often results in an excessive pull force which the user must exert upon the trigger of the crossbow to fire the arrow, which in turn decreases the accuracy of the shot.

If hunters accustomed to using rifles for hunting were to be made to feel more at ease in operating a crossbow, then presumably, more hunters who currently use rifles would hunt with crossbows. Hunters are often concerned about the reliability of the trigger assembly used to fire their weapons. If a rifle hunter were able to use the trigger assembly of the rifle normally used by such hunter in conjunction with such a crossbow, then the hunter would feel much more comfortable operating such crossbow.

Crossbows can be relatively heavy, making them more difficult to carry and operate quickly. Complex trigger mechanisms and bowstring retraction systems often contribute to such excessive weight.

Accordingly, it is an object of the present invention to provide a crossbow adapted to use the trigger assembly of a conventional modular rifle in order to fire the crossbow.

Another object of the present invention is to introduce hunters already experienced in hunting with rifles to the sport of hunting with crossbows.

Still another object of the present invention is to provide a crossbow accessory that may be quickly and conveniently attached to, and detached from, the lower receiver of a modular rifle.

A further object of the present invention is to provide a crossbow wherein the trigger pull force is independent of the draw weight of the bowstring.

A further object of the present invention is to provide a crossbow that is relatively light in weight, compact, easy to operate, and relatively inexpensive.

These and other objects of the present invention will become more apparent to those skilled in the art as the description thereof proceeds.

SUMMARY OF THE INVENTION

Briefly described, and in accordance with a preferred embodiment thereof, the present invention relates to an accessory for coupling to a modular lower receiver of a rifle, for example, the modular lower receiver of an AR-15 rifle, to form a crossbow. The aforementioned modular lower receiver includes a housing, a trigger extending from the housing, and a hammer operated by the trigger. The accessory of the present invention includes certain components that are conventionally included in a crossbow, including a rigid riser (or "prod"), and first and second flexible limbs coupled to opposing end portions of the riser. A bowstring extends between the limb tips of the first and second limbs for propelling an arrow, or "bolt". Preferably, first and second pulleys/cams are rotatably supported at the limb tips of the first and second limbs, respectively, and the bowstring extends between such first and second pulleys. Preferably, the accessory further includes power cables engaged with the first and second pulleys/cams to enhance the force/draw characteristics of the crossbow.

The preferred embodiment of the aforementioned crossbow accessory further includes an elongated frame member, generally corresponding to the "stock" or "barrel" of a conventional crossbow, but adapted for use in the present invention. A first end of the elongated frame is coupled to the central portion of the riser. The second end of the elongated frame is adapted to be removably coupled to the lower receiver of the modular rifle, preferably just above such lower receiver.

A string retractor is also coupled to the second end of the elongated frame member, preferably just above the second end of the elongated frame member. The string retractor operates to pull the bowstring away from the riser toward a drawn position proximate the second end of the elongated frame member prior to firing the crossbow. The crossbow accessory further includes a bowstring release that is capable of being disposed proximate the modular lower receiver. The bowstring release is responsive to the hammer of the lower receiver for selectively releasing the bowstring when a user pulls the trigger of the lower receiver.

Standard modular lower receivers include a pair of attachment holes to facilitate coupling the modular lower receiver to other components. One of such holes conventionally receives a "take down pin", and the other hole conventionally receives a "receiver pivot pin". Preferably, the second end of the elongated frame member includes first and second attachment holes which align and mate with the aforementioned attachment holes in the modular lower receiver. The above-described take down pin and receiver pivot pin may then be used in the usual way to couple the second end of the elongated frame member to the modular lower receiver.

The string retractor preferably includes an upper housing that is coupled to the second end of the elongated frame member. In the preferred embodiment, the upper housing rotatably supports a rope spool for selectively winding and unwinding a rope. A first end of the rope is attached to the spool, and the second end of the rope is selectively coupled to the bowstring to retract the bowstring toward its drawn position. Preferably, the spool has a hole formed transversely therethrough for receiving the first end of the rope. A winding mechanism is provided for rotating the spool to wind the rope around the spool to pull the bowstring toward its drawn position. Preferably, the spool includes at least a first gear integral with, or fixedly coupled, thereto. The aforementioned winding mechanism preferably includes a spur gear provided upon a rotatable drive axle, with the spur gear engaged with the first gear of the spool. A removable winding crank can be used to rotate the drive axle to wind the rope about the spool. In the preferred embodiment, the spool includes a second gear on an opposing side of the spool relative to the first gear, and wherein a pawl is provided within the upper housing for selective engagement with the second gear of the spool. When engaged with the second gear of the spool, the pawl permits rotation of the spool in a first direction (for tightening the rope), while preventing rotation of the spool in a second, opposing direction. Preferably, a pawl release member is also provided for disengaging the pawl from the gear when it is desired to pull the bowstring release from the upper housing after firing an arrow to retract the bowstring again.

In the preferred embodiment, the bowstring release includes a bowstring hook for selectively engaging the bowstring. The bowstring release further includes an actuating lever for releasing the bowstring hook to release the bowstring to fire an arrow. The string retractor serves to pull the bowstring release into the upper housing in a drawn position proximate to the modular lower receiver. In such drawn position, the actuating lever of the bowstring release is positioned proximate to the hammer of the modular lower receiver; the actuating lever is responsive to the hammer for selectively releasing the bowstring when a user pulls the trigger of the modular lower receiver. Preferably, the bowstring release also includes a cocking bar for cocking the hammer of the modular lower receiver as the bowstring release is retracted into the upper housing. Ideally, the cocking bar is pivotally mounted to the bowstring release; the cocking bar is prevented from pivoting when the rope of the string retractor is taut, while being retracted, to engage and cock the hammer. On the other hand, the cocking bar is free to pivot after when tension on the rope is released, as when the bowstring release is being pulled from the upper housing after an arrow is fired. Because the cocking bar is free to pivot, it avoids any interference with the hammer of the modular lower receiver when the bowstring release is pulled away from the upper housing. In the preferred embodiment, the second end of the rope engages the cocking bar to prevent the cocking bar from pivoting when the rope is taut; in this manner, the cocking bar cocks the hammer of the modular lower receiver as the bowstring is retracted.

Preferably, a channel is formed in the elongated frame member, the channel extending from at least the bowstring to the upper housing. The bowstring release slides within, and is guided by, channel formed in the elongated frame member as the bowstring release is retracted into the upper housing.

Another aspect of the present invention relates to a method of providing a crossbow using a modular lower receiver of a rifle of the type that includes a housing, a trigger extending from the housing, and a hammer operated by the trigger. In practicing such method, one provides an accessory which includes a riser, first and second limbs coupled to opposing ends of the riser, a bowstring extending between the limb tips of the first and second limbs for propelling an arrow, an elongated frame member having a first end coupled to the riser and an opposing second end, and a bowstring release capable of being disposed proximate the second end of the elongated frame member. The bowstring release includes a bowstring hook for selectively engaging the bowstring, and an actuating lever for releasing the bowstring hook. Preferably, such method includes the step of providing first and second pulleys, or cams, rotatably supported at the limb tips of the first and second limbs, and extending the bowstring between such first and second pulleys/cams.

In further practicing such method, one fastens the second end of the elongated frame member to the modular lower receiver. In this regard, the modular lower receiver typically includes attachment holes to facilitate coupling of the modular lower receiver to other components. The second end of the elongated frame member preferably includes attachment holes which mate with the attachment holes in the modular lower receiver. The step of fastening the second end of the elongated frame member to the modular lower receiver preferably includes the step of inserting fastening pins through mating attachment holes in the modular lower receiver and in the second end of the elongated frame member to couple the second end of the elongated frame member to the modular lower receiver.

The method of the present invention further includes the step of retracting the bowstring toward the second end of the elongated frame member for pulling the bowstring away from the riser toward a drawn position proximate the second end of the elongated frame member. When in its drawn position, the bowstring is engaged with the bowstring hook of the bowstring release.

The method of the present invention further includes the step of positioning the actuating lever of the bowstring release proximate to the hammer of the modular lower receiver for being contacted by the hammer to release the bowstring when the trigger of the modular lower receiver is operated.

In the preferred embodiment of applicants' method, the step of retracting the bowstring includes the steps of engaging the bowstring hook of the bowstring release with the bowstring before the bowstring is retracted, and retracting the bowstring release toward the second end of the elongated frame member, thereby pulling the bowstring away from the riser toward its drawn position proximate the second end of the elongated frame member. Preferably, an upper housing is provided at the second end of the elongated frame member, and the retracting step includes the step of pulling the bowstring release into the upper housing proximate the modular lower receiver; the actuating lever of the bowstring release may advantageously be positioned proximate to the hammer of the modular lower receiver, whereby operation of the trigger of the lower receiver, and resulting rotation of the hammer, cause the bowstring release to release the bowstring therefrom.

The present invention may be further enhanced by securing a cocking bar to the bowstring release, and engaging the cocking bar with the hammer of the modular lower receiver, as the bowstring release is retracted, to cock the hammer of the modular lower receiver. Preferably, the aforementioned method includes the steps of pivotally securing the cocking bar to the bowstring release, and securing the second end of the rope to the cocking bar. When the winding rope is taut (as when the bowstring is being retracted), the cocking bar is restrained against pivotal movement. Further retraction of the bowstring causes the cocking bar of the bowstring release to engage the hammer, and to rotate the hammer to its cocked position. On the other hand, after the bowstring is released, and the winding rope is allowed to slacken, the cocking bar is allowed to pivot around the hammer of the modular lower receiver to permit the bowstring release to be withdrawn from the upper housing.

Preferably, applicants' method includes the step of providing an upper housing proximate the second end of the elongated frame member. Ideally, the retracting step includes the steps of rotatably supporting a spool within the upper housing, winding the first end of a rope about the spool, coupling a second, opposing end of the rope to the bowstring release, and rotating the spool to wind the rope around the spool to pull the bowstring release, and the bowstring, toward the drawn position. In the preferred embodiment, the step of winding the first end of the rope about the spool includes the steps of forming a rope attachment hole extending transversely through the spool; and passing the first end of the rope through the rope attachment hole for securing the first end of the rope to the spool.

In the preferred embodiment of the present invention, the method includes the further steps of coupling a gear to the spool; and engaging a pawl with the gear for permitting rotation of the spool in a first direction, and for selectively preventing rotation of the spool in a second, opposing direction.

In regard to the step of rotating the spool, the preferred form of applicants' method includes the steps of coupling a first gear to the spool, rotatably mounting a drive axle in the upper housing, providing a spur gear on the drive axle, engaging the spur gear with the first gear of the spool, and cranking the drive axle to rotate the spool and to wind the rope about the spool to retract the bowstring release and the bowstring.

DETAILED DESCRIPTION OF THE PREFERRED EMBODIMENTS

Figure 1:
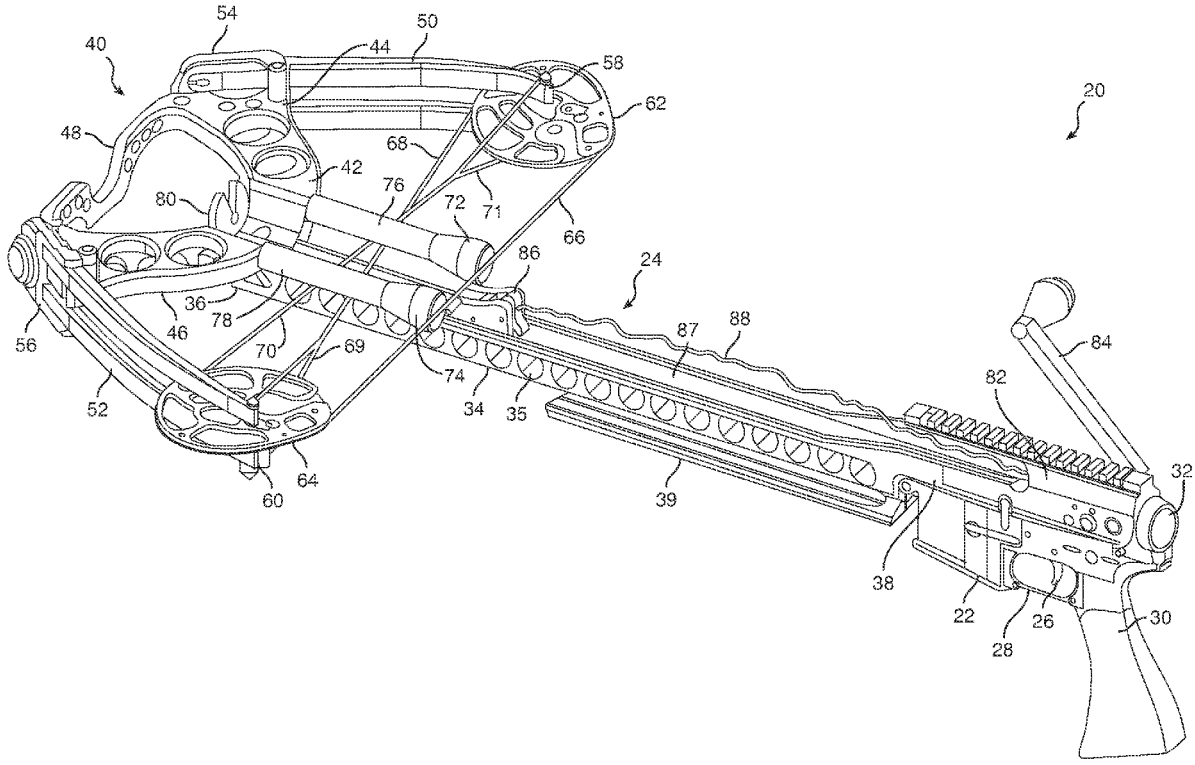
FIG. 1 is a perspective view of a crossbow accessory in accordance with a preferred embodiment of the present invention.

FIG. 1 shows a crossbow, designated generally by reference numeral 20, and including the modular lower receiver 22 of an AR-15 style rifle attached to crossbow accessory 24. While the preferred embodiment uses an AR-15 style lower receiver 22, those skilled in the art will appreciate that the present invention can also be practiced by using lower receivers of other models of rifles. In addition, while the preferred embodiment of the present invention is a crossbow accessory for an existing lower receiver already owned by a user, those skilled in the art will appreciate that a manufacturer could, if desired, supply such a lower receiver with crossbow accessory 24 as a packaged assembly.

As is known to gun enthusiasts, lower receiver 22 includes a finger trigger 26 which extends downwardly from the housing of lower receiver 22. A trigger guard 28 may also be included. A pistol grip 30 is also preferably provided along with lower receiver 22. The rear end of lower receiver 22 includes a threaded opening 32 adapted to receive a removable buttstock. For example, a buttstock of the type shown and described in U.S. Pat. No. 7,363,740 to Kincel, may be threadedly engaged with the threaded opening 32 of lower receiver 22. The addition of such a buttstock allows for positioning crossbow 20 against the user's shoulder for increased accuracy.

While not illustrated in FIG. 1, lower receiver 22 also houses a spring-biased hammer that may be cocked into a firing position and subsequently released by pulling trigger 26. The structure and operation of the trigger, hammer, and a related "disconnector" used in a conventional AR-15 style lower receiver are described and illustrated within U.S. Pat. No. 5,680,724 (Peterken) and U.S. Pat. No. 6,722,072 (McCormick), the disclosures of which are hereby incorporated by reference. The hammer is ordinarily used to strike a firing pin on an ammunition casing to fire a bullet.

Turning to crossbow accessory 24, an elongated frame member 34, preferably made of aluminum, extends between a first end 36 and a second opposing end 38. Frame member 34 generally corresponds to the stock, barrel, or main rail, of a conventional crossbow. Openings, such as circular opening 35, may be machined along frame member 34 to lessen the weight thereof. If desired, a grooved accessory mounting rail 39, sometimes called a "Picatinny" rail", may be provided along the bottom of frame member 34 for mounting hand grips or other modular accessories often sold for use with AR-15 style rifles.

The first, or forward-most, end 36 of frame member 34 is secured to a riser 40. Riser 40 includes a central portion 42 and opposing end portions 44 and 46. A conventional foot stirrup portion 48 may also be formed integrally with riser 40, if desired. Riser 40 is preferably formed of machined aluminum. First and second flexible limbs 50 and 52 extend from end portions 44 and 46, respectively, of riser 40. As illustrated, limbs 50 and 52 are each preferably formed as "split limbs". Preferably, split limbs 50 and 52 are secured to riser end portions 44 and 46 by pivoting pocket members 54 and 56, respectively. Split limbs 50 and 52 are preferably formed of fiberglass. Limb 50 has a limb tip 58, and limb 52 has a limb tip 60.

In the preferred embodiment, first and second pulleys, preferably in the form of power cams, 62 and 64 are rotatably mounted at limb tips 58 and 60, respectively. As used herein, the term "pulley" is intended to include both circular pulleys and non-circular cams. Pulleys 62 and 64 are preferably formed of machined aluminum. It is possible to form a crossbow, in accordance with the present invention, without the use of cams or pulleys, corresponding to a conventional recurve archery bow wherein the bowstring extends directly from one limb tip to the opposing limb tip. However, the use of cams/pulleys 62 and 64 is preferred for improved performance. As used herein, a description of the bowstring 66 extending between the limb tips of the first and second limbs 50 and 52 should be understood to be inclusive of both simple recurve-style bows (without any cams or pulleys) and compound-style bows (having cams or pulleys rotatably supported at the limb tips).

A bowstring 66 extends between pulleys 62 and 64 for propelling an arrow, or "bolt". In addition, a pair of power cables, or tension cables, 68 and 70 also engage pulleys 62 and 64 to maximize the efficiency of the force applied to the arrow by bowstring 66 as an arrow is fired. Power cable 68 extends from a groove on pulley 62 to a split cable harness 69 secured to the pivot axle of opposing pulley 64. Likewise, power cable 70 extends from a groove on pulley 64 to a split harness 71 secured to the pivot axle of opposing pulley 62. As bowstring 66 is retracted toward second end 38 of frame member 34, additional portions of bowstring 66 play off of pulleys 62 and 64, while pulleys 62 and 64 wind additional portions of power cables 68 and 70. When bowstring 66 is released from a drawn position, pulleys 62 and 64 wind additional portions of bowstring 66, while power cables 68 and 70 unwind from pulleys 62 and 64. Bowstring 66, and power cables 68 and 70, are preferably made from a blend of braided Dyneema/Vectran high-molecular weight cord. The braided string and cables each preferably include 16 strands of such cord braided together. Bowstring 66 preferably has a "D-loop" 67 (see FIG. 18A) attached thereto at the nocking point, i.e., at the point where the arrow nock is engaged with bowstring 66. This D-loop 67 is engaged by a bowstring hook 162 of a bowstring release 86 in a manner described in greater detail below.

Still referring to FIG. 1, a pair of rubber stoppers 72 and 74 are positioned adjacent bowstring 66 (when bowstring 66 is at rest). Rubber stoppers 72 and 74 are supported by cylindrical rods 76 and 78, respectively, which are, in turn, attached to riser 40. Ideally, power take up cables 68 and 70 extend below and around rods 76 and 78. In this manner, rods 76 and 78 function as cable guides to deflect cables 68 and 70 away from the path of an arrow being fired. Rubber stoppers 72 and 74 serve to dampen the force of the bowstring after an arrow is fired from the crossbow.

In the preferred embodiment, the crossbow provided herein is of a "rail-less" type, meaning that the arrow being fired by the crossbow does not slide along a rail as it is being released from the crossbow. By making the crossbow rail-less, frictional drag on the arrow is reduced. The only support for the arrow being fired is provided at the rear of the arrow, where the nock of the arrow is engaged by bowstring 66, and by an arrow rest 80 secured to riser 40. The upper surface of frame member 34 preferably includes a channel 87, but channel 87 is not used to support the arrow as the arrow is being fired. In an alternate embodiment, one could, if desired, operate a crossbow of the present invention using a "rail" with minor modifications. However, "rail-less" operation is preferred.

Also depicted within FIG. 1 is an upper housing 82, a removable crank arm 84, a bowstring release 86 and a retractor rope 88. Bowstring release 86 is guided by channel 87 formed upon the upper surface of frame member 34. Additional details regarding upper housing 82, crank arm 84, bowstring release 86, and retractor rope 88, are provided herein. Retractor rope 88 is preferably made from a braided Dyneema ("Spectra") high-molecular weight cord having a diameter of 7/64 inch and rated at 1,400 pounds of tensile pull breaking strength. This allows the rope spool to be kept compact and yet is strong enough to avoid breakage under the 170 pound force exerted by the bowstring.

Figure 2A:
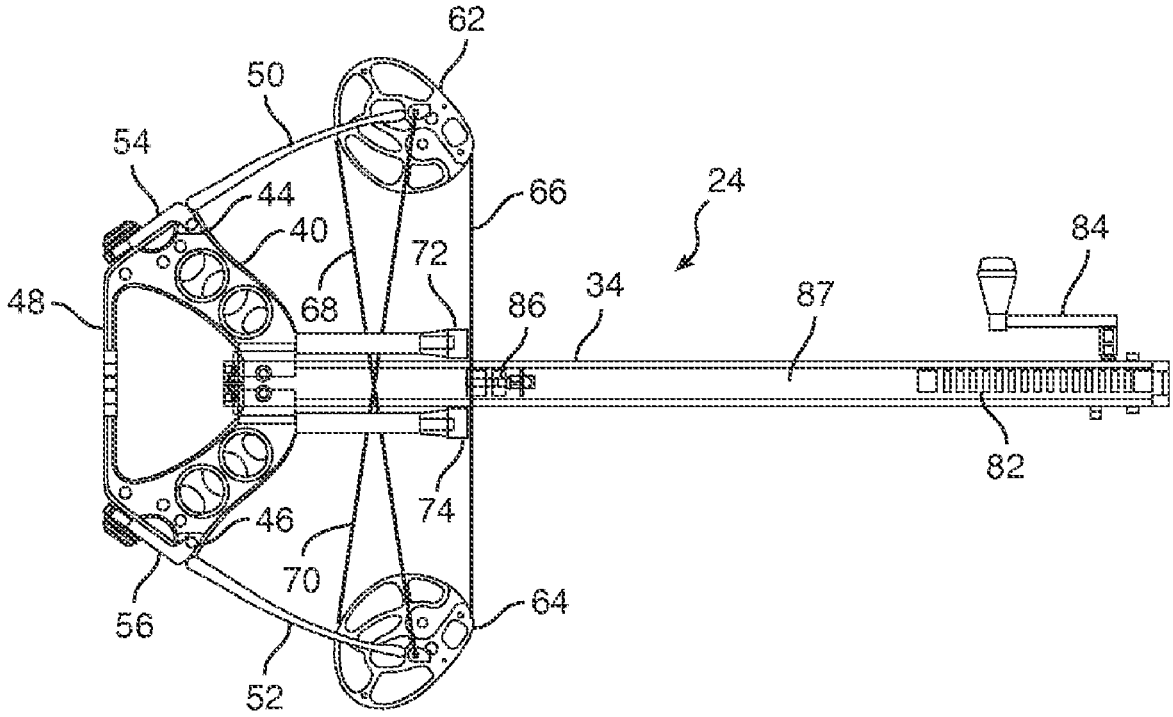
FIG. 2A is a top view of the crossbow accessory shown in FIG. 1 with the bowstring in its rest position, and with a crank arm attached to the bowstring retraction mechanism.
Figure 2B:
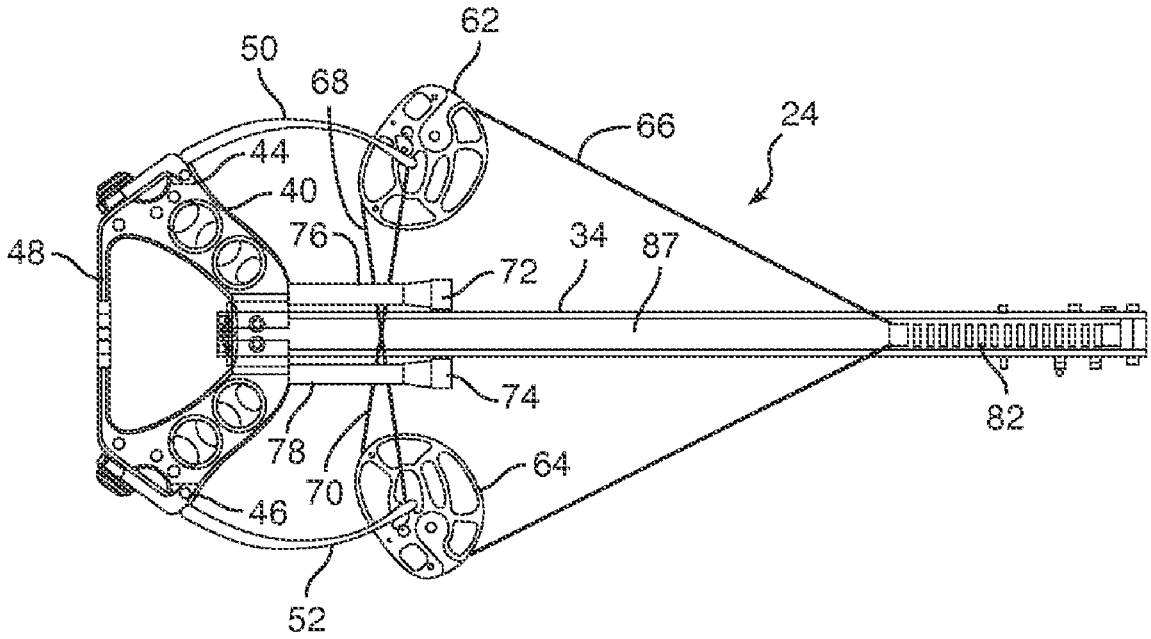
FIG. 2B is a top view of the crossbow accessory shown in FIG. 1 with the bow in its fully-drawn position, and with the crank arm removed from the bowstring retraction mechanism.

FIGS. 2A and 2B are top views of the crossbow accessory 24 shown in FIG. 1. In FIG. 2A, crossbow accessory 24 is shown with the bowstring in its rest position (at "brace height"), and with crank arm 84 attached to the bowstring retraction mechanism for retracting bowstring release 86 and bowstring 66. In FIG. 2B, crossbow accessory 24 is shown in its fully-drawn position, wherein bowstring release 86 is hidden within upper housing 82, and with crank arm 84 having been removed from the bowstring retraction mechanism.

Figure 3:
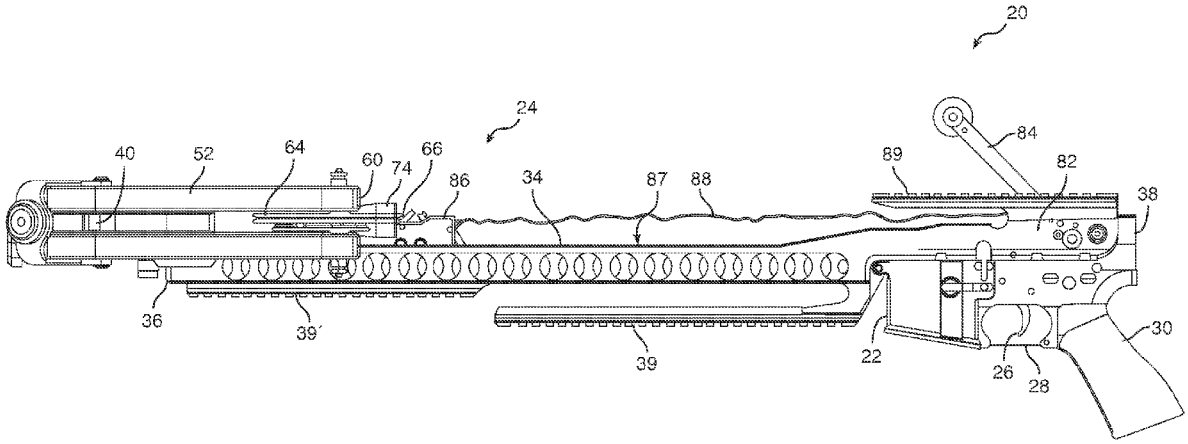
FIG. 3 is a side view of the crossbow accessory shown in FIGS. 1 and 2A with the bow in its rest position, and with a crank arm attached to the bowstring retraction mechanism.

The side view shown in FIG. 3 of crossbow 20, lower receiver 22 and crossbow accessory 24 shows many of the same components already described in regard to FIG. 1. Retractor rope 88 has been pulled out of upper housing 82 by a sufficient length to permit bowstring release to move forwardly along channel 87 to engage bowstring 66. Grooved accessory mounting rail 39 extends along and below a central portion of frame member 34; optionally, a further grooved accessory mounting rail 39' may extend along the bottom of the frontmost portion of frame member 34. Similarly, a grooved accessory mounting rail 89 may be provided along the top surface of upper housing 84 to facilitate the mounting of a telescopic sight, laser pointers, other optics, etc.

Figure 4:
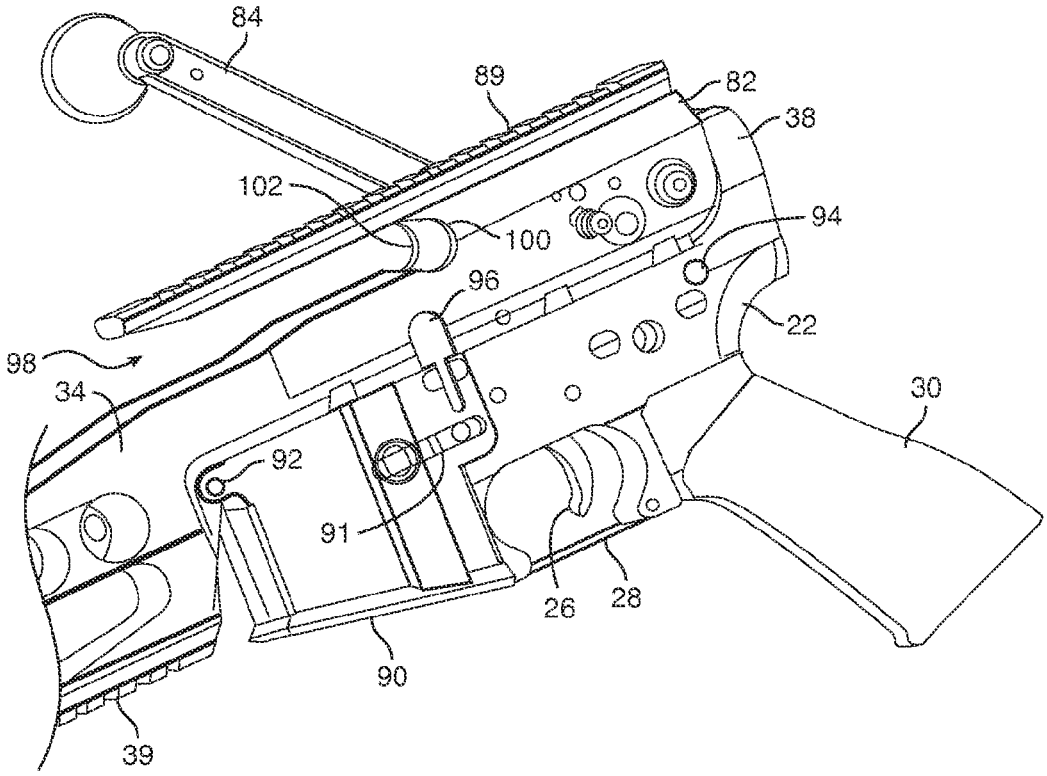
FIG. 4 is an enlarged partial perspective view of an AR-15 lower receiver attached to the second end of the elongated frame member of the crossbow accessory, and illustrating an upper housing of the crossbow accessory.
Figure 5:
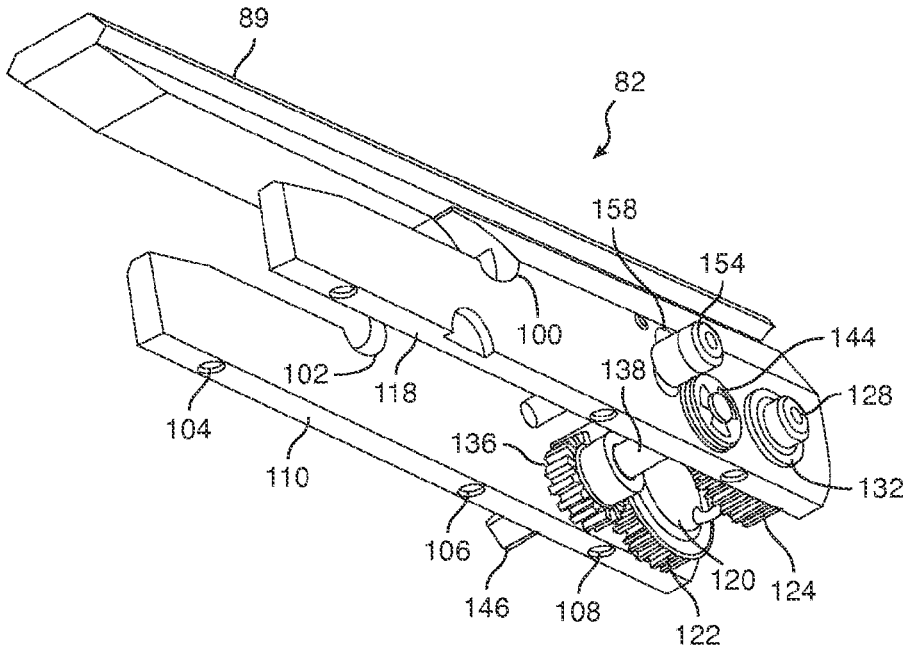
FIG. 5 is a perspective view of the upper housing, viewed from below, and prior to attachment to the second end of the elongated frame member of the crossbow accessory.

Referring to FIG. 4, lower receiver 22 include a magazine port 90 which ordinarily receives an ammunition magazine, but which is not used when crossbow accessory 24 is attached to lower receiver 22. Likewise, the "magazine catch" 91 is also left unused when crossbow accessory 24 is being used. Similarly, "bolt catch" 96 is not needed when crossbow accessory 24 is in use.

Lower receiver 22 is attached to the rear end of frame member 38 by two pins. The forward-most pin 92 is typically referred to as the "receiver pivot pin", and extends through mating holes in lower receiver 22 and second end 38 of frame member 34. The receiver pivot pin is engaged from the opposite side by a receiver pivot pin screw to prevent the receiver pivot pin from falling out unintentionally. The rearmost pin 94 is typically referred to as the "take down pin". The take down pin again extends through mating holes in lower receiver 22 and second end 38 of frame member 34. A spring-biased detent pin (not shown) engages the take down pin laterally along its shaft to prevent the take down pin from being removed unintentionally. These same two pins are conventionally used to attach lower receiver 22 to other AR-15 style modular rifle components.

Still referring to FIG. 4, it will be noted that upper housing 82 includes a throat 98 adapted to receive bowstring release 86. Throat 98 terminates in a pair of generally circular cut-outs 100 and 102 formed in the opposing sidewalls of upper housing 82. As will be explained in greater detail below, alignment pins extending from opposing sides of bowstring release 86 engage cut-outs 100 and 102 for seating bowstring release in a fixed position when bowstring release 86 is retracted into upper housing 82. Because bowstring release 86 is retracted into the same fixed, drawn position in upper housing 82 each time that bowstring 66 is retracted, the power stroke of the crossbow is always the same each time the crossbow is fired.

FIGS. 5-10 generally illustrate the features of upper housing 82. Upper housing 82 is preferably made from machined aluminum. As shown best in FIGS. 5 and 9A, a series of threaded mounting holes extend upwardly into side wall 110 of upper housing 82 for receiving corresponding attachment screws 112, 114 and 116, respectively, used to attach side wall 110 of upper housing 82 to second end 38 of frame member 34. Similar mounting holes are provided in opposing side wall 118.

Figure 6:
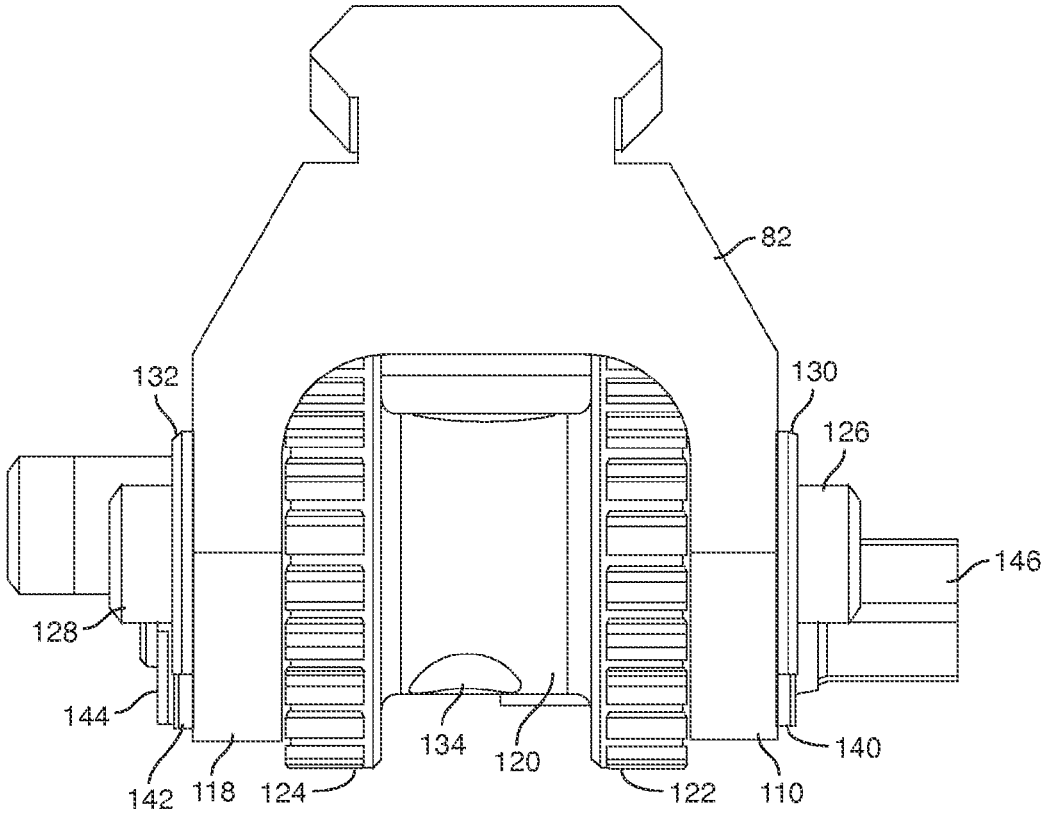
FIG. 6 is a rear view of the upper housing shown in FIG. 5, and illustrating a rope spool rotatably supported therein.
Figure 7:
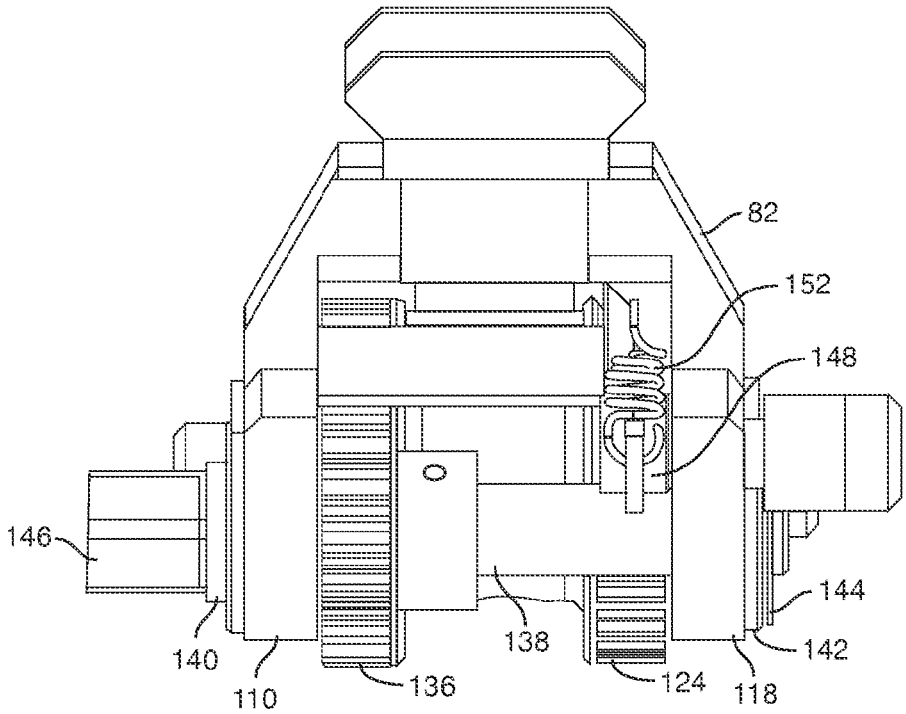
FIG. 7 is a front view of the upper housing shown in FIG. 5, and illustrating a spur gear and drive axle used to rotate the rope spool.
Figure 8:
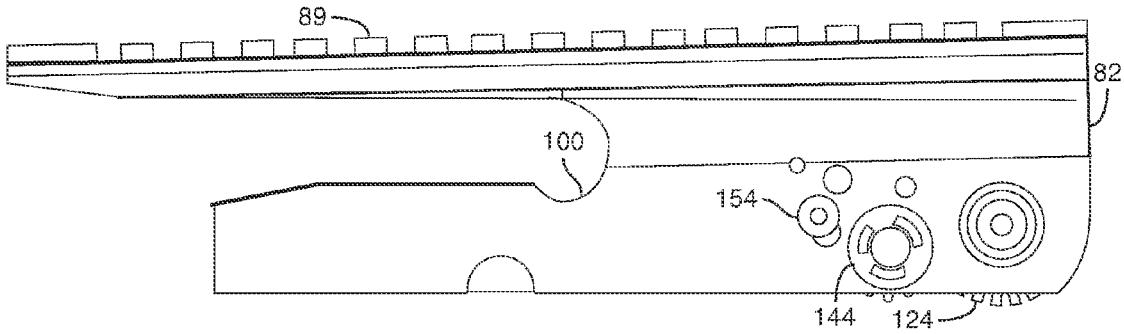
FIG. 8 is a side view of the upper housing shown in FIG. 5.
Figure 10:
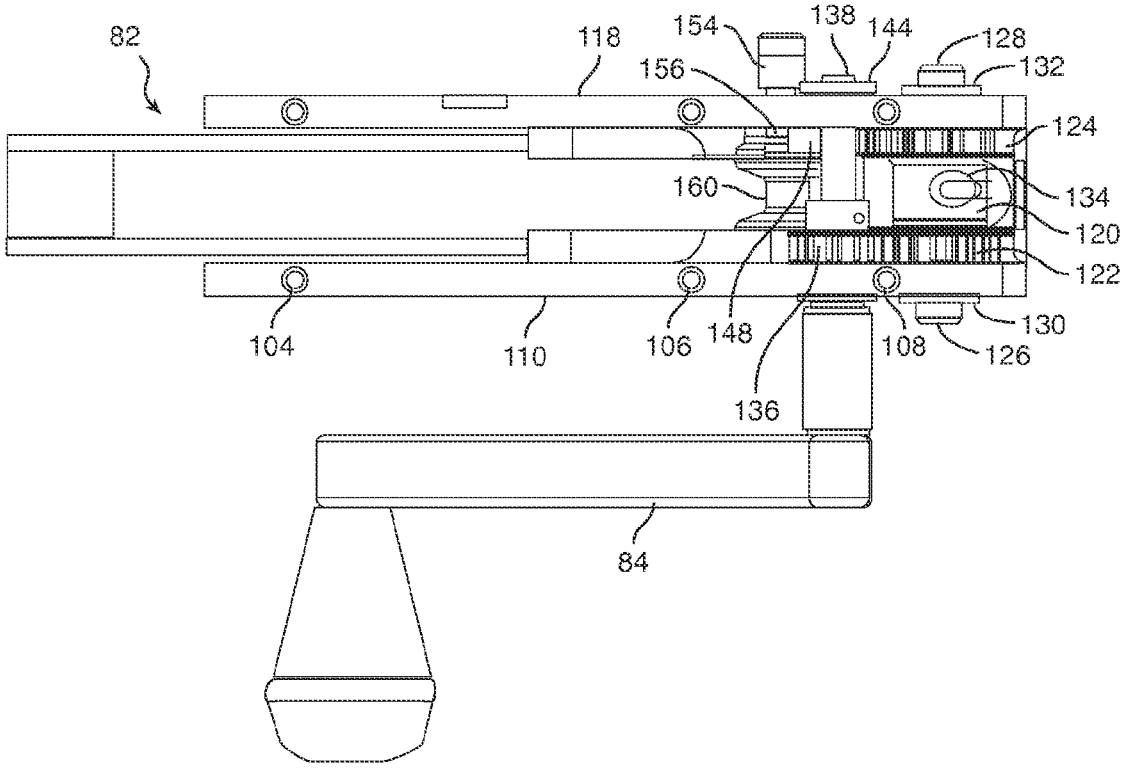
FIG. 10 is a bottom view of the upper housing with the crank arm attached, and the pawl disengaged.

Apart from serving to properly guide bowstring release 86 into its fully-drawn position, upper housing 82 also preferably contains the components used to retract bowstring release 86, and bowstring 66 engaged therewith, away from the riser into the fully-drawn position proximate second end 38 of frame member 34. Referring briefly to FIGS. 6 and 10, a rope spool 120 is formed between a pair of gears 122 and 124. In the preferred embodiment, spool 120 and gears 122 and 124 are integrally machined from hardened tool steel rated at 250 KSI (1,000 psi). Spool 120 and associated gears 122 and 124 are rotatably supported between side walls 110 and 118 of upper housing 82 by a pair of bolts 126 and 128 which extend through holes formed in such side walls into threaded holes formed in the centers of gears 122 and 124. Smooth portions of the shafts of bolts 126 and 128 are supported by bearings 130 and 132, respectively, which bearings are supported within the aforementioned holes formed in the side walls 110 and 118 of upper housing 82. Preferably, spool 120 has a hole 134 formed transversely therethrough for receiving the first end of the retractor rope 88.

In order to rotate spool 120 when retracting rope 88, a spur gear 136 is engaged with spool gear 122. Spur gear 136 is attached to drive axle 138. Drive axle 138 is rotatably supported between side walls 110 and 118 of upper housing 82. Holes are formed in side walls 110 and 118 to accommodate bearings 140 and 142 that rotatably support drive axle 138. A retainer clip 144 is secured over one end of drive axle 138 to retain drive axle 138 within upper housing 82. The opposite end of drive axle 138 includes a square-shaped head 146 for releasably receiving winding crank arm 84. After attaching crank arm 84 over square-shaped head 146, crank arm 84 is rotated to rotate drive axle 138 and spur gear 136, which rotates spool gear 122 and spool 120 to wind rope 88 thereabout. Spur gear 136 includes 14 gear teeth, while spool gears 122 and 124 each include 22 teeth. Accordingly, the force that needs to be applied by a user to crank arm 84 in order to retract bowstring 66 is reduced by the mechanical advantage of the gear ratio 14:22. Crank arm 84 is preferably about five inches in length, compared to the much smaller diameters of gears 136, 122 and 124, and rope spool 120, providing a further mechanical advantage.

Figure 11:
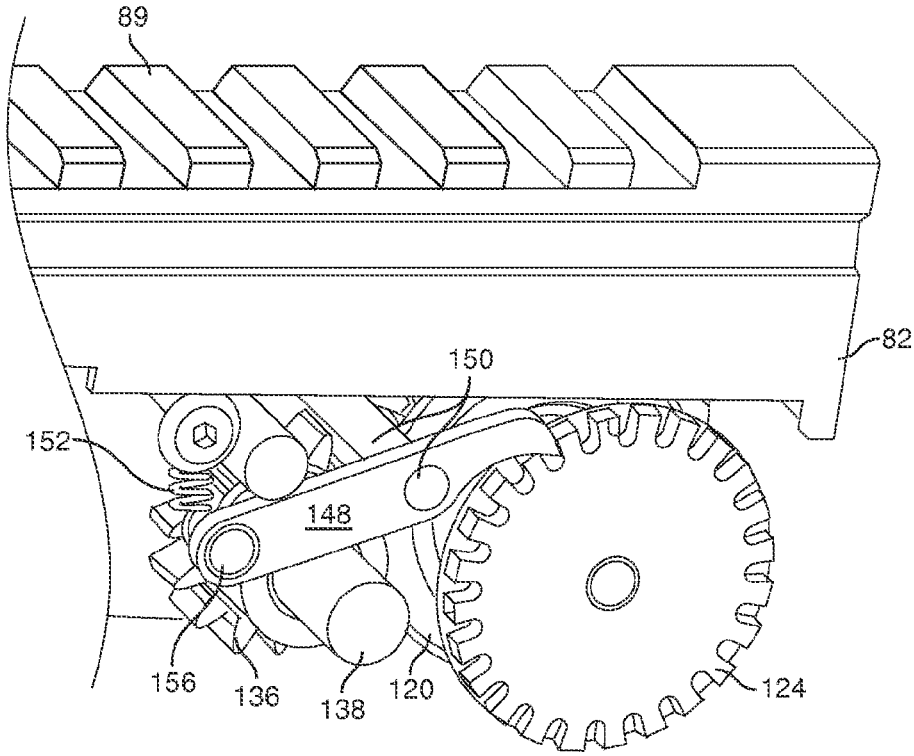
FIG. 11 is an enlarged perspective, sectional view of the gearing and pawl used to wind, and retain, the rope upon the rope spool.
Figure 12:
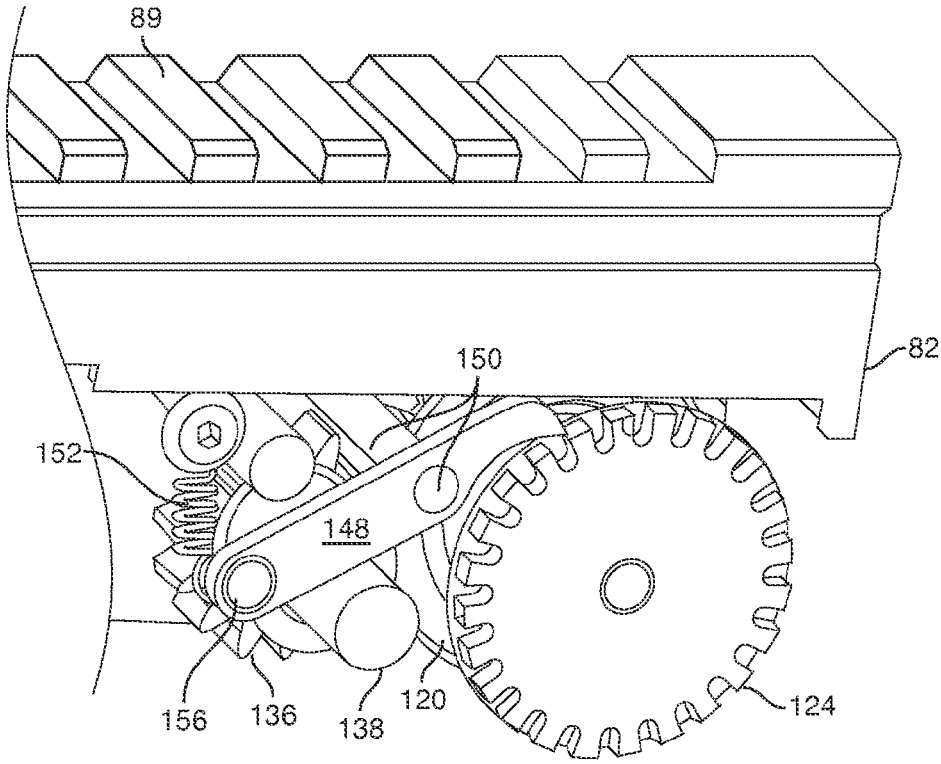
FIG. 12 is a an enlarged view similar to FIG. 11 but with the pawl released for allowing the bowstring release and rope to be withdrawn from the upper housing.

In the absence of any other components, were the user to let go of crank arm 84 after retracting the bowstring, then rope 88 would be pulled back off of spool 120 by the force of the bowstring. To prevent this from happening, a spring-biased pawl 148 is ordinarily engaged with spool gear 124. As shown best in FIG. 11, pawl 148 is mounted for pivotal movement about pin 150 which extends between side walls 110 and 118. Pawl 148 can pivot between an engaged position (see FIGS. 9A and 11) and a released position (see FIGS. 9B and 12). Biasing spring 152 normally pulls pawl 148 into engagement with spool gear 124; in that case, spool gear 124 may be rotated clockwise (relative to FIGS. 5, 9A, and 11), but not counter-clockwise. The retractor rope winds about the top of spool 120 as crank arm 84 is rotated. If crank arm 84 is released, pawl 148 engages a tooth of spool gear 124, preventing spool 120 from turning in the opposite direction, and preventing rope 88 from unwinding from spool 120.

Figure 9A:
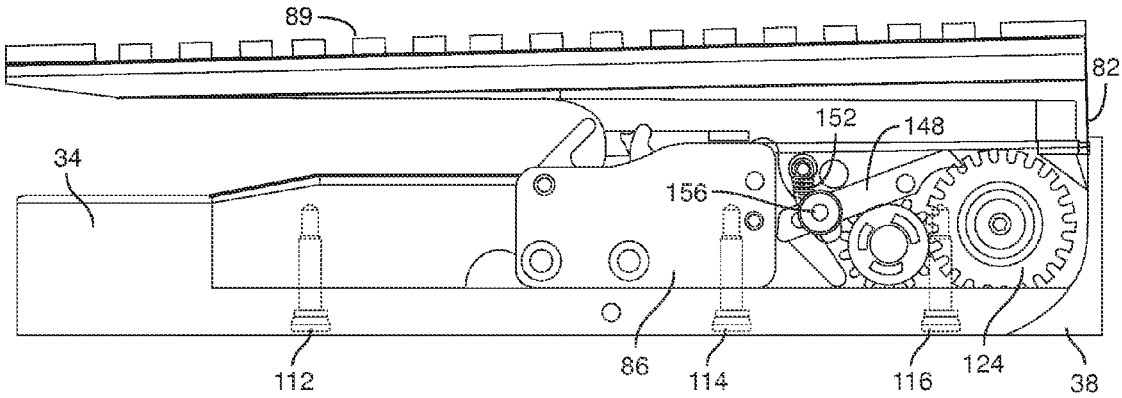
FIG. 9A is a cross-sectional view of the upper housing shown in FIG. 8 wherein a bowstring release has been retracted into the upper housing into its proper drawn position for firing, and wherein a pawl engages one the rope spool gears.
Figure 9B:
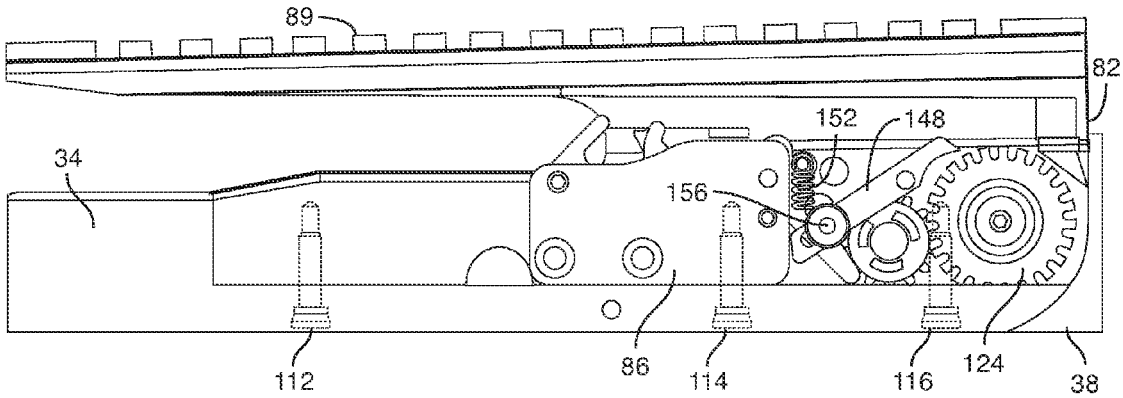
FIG. 9B is a cross-sectional view similar to FIG. 9A but wherein the bowstring release has been retracted into the upper housing beyond its proper drawn position, and wherein the pawl is disengaged from the rope spool gear.

Referring briefly to FIGS. 9A and 9B, bowstring release 86 is shown received within upper housing 82. In FIG. 9A, bowstring release 86 has been advanced to its proper fully-drawn position, and is ready for firing. In some instances, represented by FIG. 9B, bowstring release 86 may actually be retracted too far into upper housing 82, i.e., beyond to its proper fully-drawn position. However, as shown in FIG. 9B, this causes the rearmost edge of bowstring release 86 to engage the forward-most end of pawl 148, thereby pivoting pawl 148 out of engagement with spool gear 124. As a result, when a user releases crank arm 84, a small amount of rope will unwind from spool 120 until bowstring release 86 no longer engages pawl 148. Spring 152 then forces pawl 148 back into engagement with spool gear 124, thereby ensuring that bowstring release 86 will revert to its proper fully-drawn position.

After firing an arrow from crossbow 20, a user will need to remove bowstring release 86, and retractor rope 88, from upper housing 82 in order to again retract bowstring 66 for the next shot. However, pawl 148 prevents spool 120 from unwinding rope 88 therefrom. Accordingly, a pawl release knob 154 extends from upper housing 82 for allowing the user to forcibly disengage pawl 148 from spool gear 124 to free spool 120. Pawl release knob 154 is attached to a pin 156 that extends through a vertical slot 158 (see FIG. 5) formed in side wall 118 of upper housing 82. Pin 156 is coupled to the forward-most end of pawl 148. When a user pushes pawl release knob downwardly, against the biasing force of spring 152, pin 156 forces the forward-most end of pawl 148 downward, thereby pivoting the rear end of pawl 148 upward, and away from spool gear 124. Thus, if the user pushes down on pawl release knob while withdrawing bowstring release 86 from upper housing 82, the rope retractor assembly will not offer any resistance to such movement.

While not essential, a guide pulley 160 (see FIG. 10), preferably formed of brass, may be rotatably supported within upper housing 82 between side walls 110 and 118 to help guide rope 88 toward spool 120. In addition, those skilled in the art will appreciate that crank arm 84 could, if desired, be used to directly drive rope spool 120 without the aid of a spur gear. While this direct drive approach loses the mechanical advantage provided by spur gear 136, a direct drive system may be suited to crossbows having lesser draw weights. For direct drive, spur gear 136, drive axle 138, and spool gear 122 would be eliminated. The square shaped head 146 would be moved to an extension of a rope spool axle, and crank arm 84 would then be removably connected directly to the rope spool axle. Spool gear 124, and pawl 148 would be retained to prevent rope spool 120 from unwinding rope 88 unintentionally.

Figure 13:
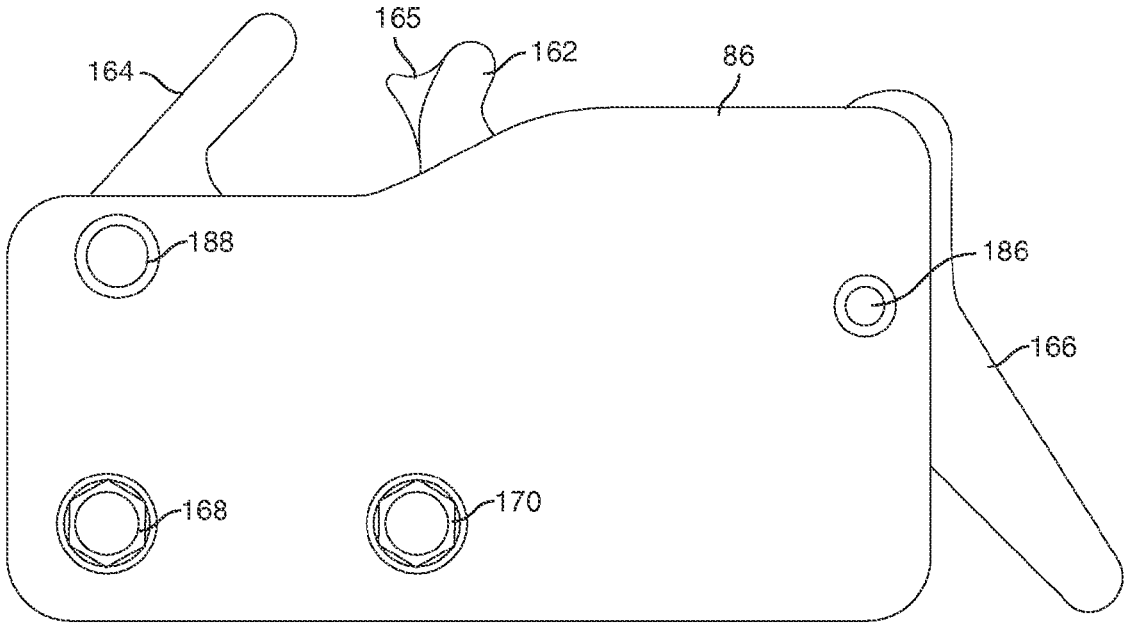
FIG. 13 is a side view of the bowstring release assembly isolated from the other components of the bowstring accessory.
Figure 14:
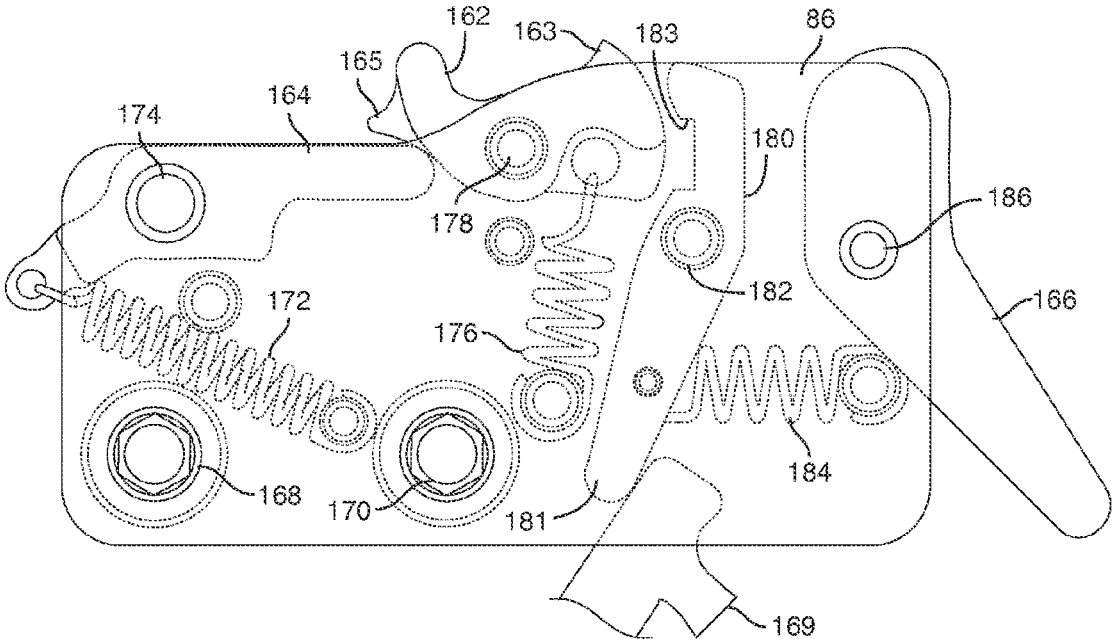
FIG. 14 is a cross-sectional view of the bowstring release assembly shown in FIG. 13, after an arrow is fired.

Turning now to FIGS. 13-18, bowstring release 86 will be described in greater detail. Bowstring release 86 includes a bowstring hook 162, an anti-dry fire (ADF) catch 164, and a cocking lever 166, all of which are pivotally mounted within bowstring release 86. Screws help to secure bowstring release 86 together. As shown in FIG. 14, bias spring tends to pull ADF catch 164 to its upward position, or counter-clockwise about its pivot pin 174 relative to FIG. 14. Bias spring 176 tends to pull bowstring hook 162 upwardly, or clockwise about its pivot pin 178. Sear member 180 does not protrude from bowstring release 86; sear member 180 pivots about pivot pin 182 and is biased in a counter-clockwise direction, relative to FIG. 14, by bias spring 184. Cocking lever 166 (also referred to herein as a "cocking bar") pivots about pivot pin 186 and does not require a biasing spring.

Figure 16:
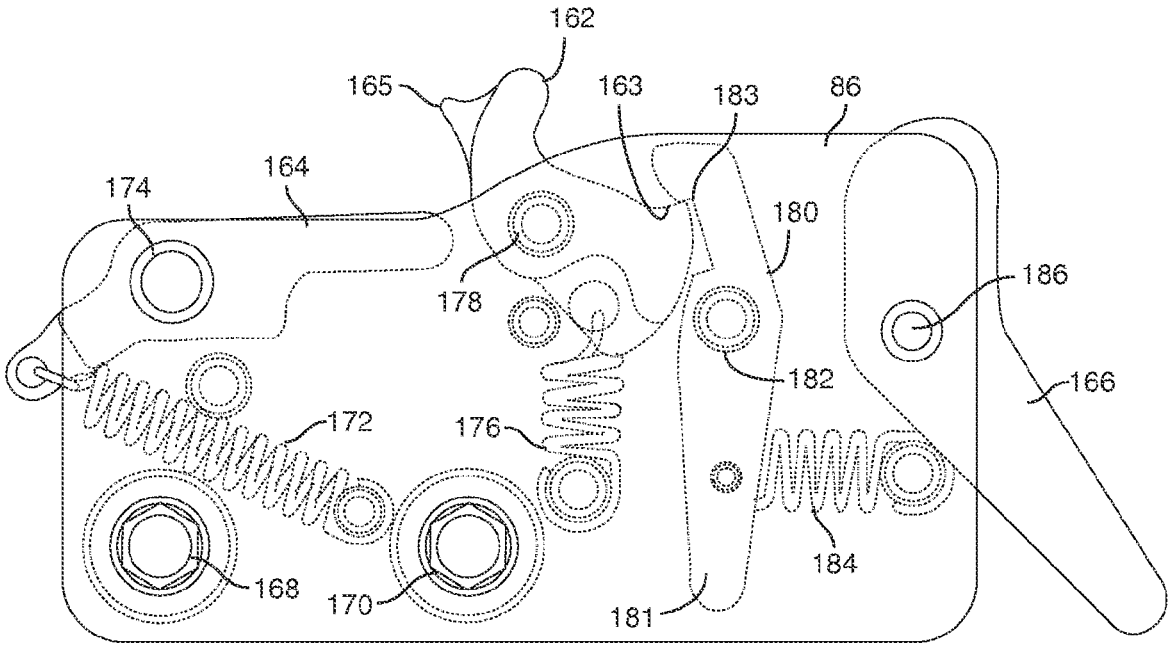
FIG. 16 is a cross-sectional view of the bowstring release assembly shown in FIG. 13, and wherein the bowstring release is armed and ready for firing.

FIG. 16 shows the relationship of the bowstring release components immediately before an arrow is fired. The aforementioned D-loop 67 formed on bowstring 66 (see FIG. 18A) is engaged by bowstring hook 162, and an arrow (not shown in FIG. 16) is nocked with bowstring 66. Bowstring release 86 has been retracted into its drawn position within upper housing 82. ADF catch 164 is depressed to a horizontal configuration, against the force of bias spring 172, by the presence of the arrow nocked with bowstring 66. Bowstring hook 162 includes a sear edge 163 engaged with sear edge 183 on sear member 180. Bias spring 184 is pulling on the lower end 181 of sear member 180 to keep sear edges 163 and 183 engaged. Bias spring 176, which ordinarily pulls bowstring hook 162 clockwise (relative to FIG. 16) is essentially ineffective since bowstring 66 is pulling bowstring hook 162 in a counter-clockwise direction (relative to FIG. 16) with much greater force. Bowstring release 86 is positioned within upper housing 82, and proximate the second end 38 of frame member 34 such that the lower end of sear member 181 lies adjacent to the path of the hammer of lower receiver 22.

FIG. 14 shows the relationship of the bowstring release components immediately after an arrow is fired. When the trigger 26 of lower receiver 22 is pulled, hammer 169 of lower receiver 22 swings forward, striking the lower end of sear member 181 with a force tending to rotate sear member 181 in a clockwise direction relative to FIG. 14. Accordingly, sear edge 183 of sear member 180 is disengaged from sear edge 163 of bowstring hook 162. The force exerted by the D-loop 67 (approximately 170 pounds) rapidly pulls bowstring hook 162 in a counter-clockwise direction, releasing the bowstring 66 from bowstring release 86.

Figure 15:
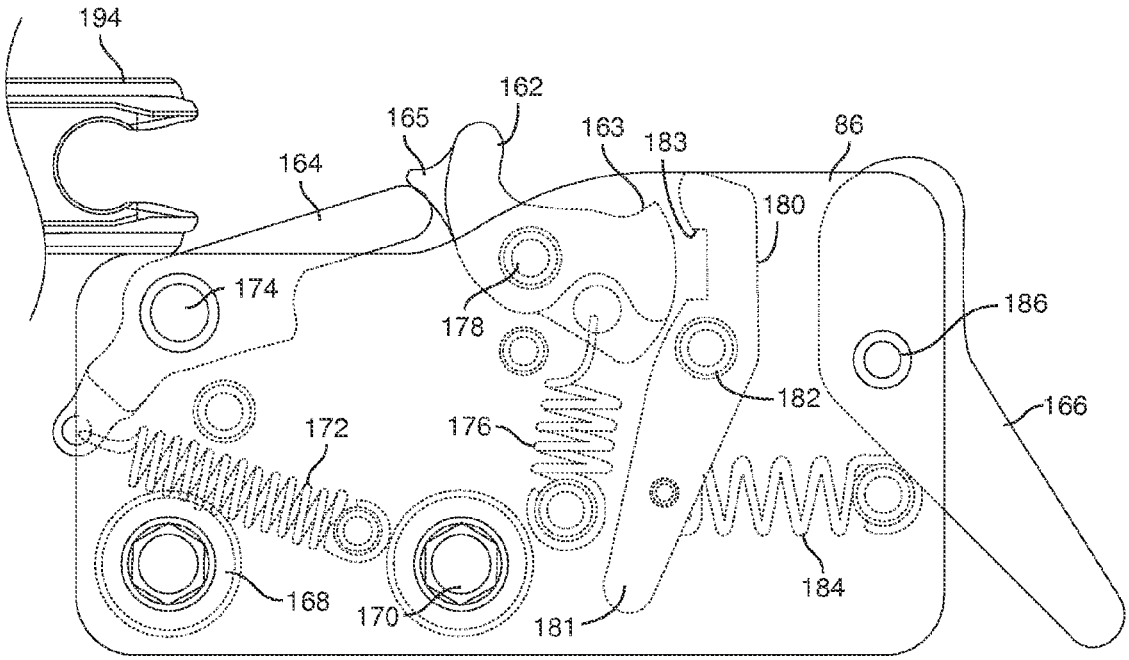
FIG. 15 is a cross-sectional view of the bowstring release assembly shown in FIG. 13, illustrating how the bowstring hook retards an ADF catch from rising prematurely immediately after the bowstring is released.

As noted above, bowstring release includes an anti-dry fire mechanism wherein ADF catch 164 prevents the release of D-loop 67 attached to bowstring 66 if no arrow is properly nocked with bowstring 66 at the time of firing. If a crossbow is fired without an arrow present, the forces generated by the crossbow can result in the bowstring and/or power cables breaking, or in the entire crossbow coming apart, posing a significant danger to the user and others nearby. Referring to FIGS. 13, 15, and 18A, ADF catch 164 is normally pulled upright by bias spring 172. As shown in FIG. 18A, bowstring 66 lies just ahead of ADF catch 164, while D-loop 67 is engaged by bowstring hook 162, behind ADF catch 164. Under normal firing conditions, arrow nock 194 (see FIG. 15) is engaged with bowstring 66, and the presence of arrow nock 194 forces ADF catch 164 downward to a more horizontal position (as per FIG. 16). If trigger 26 of lower receiver 22 is now pulled, and hammer 169 of lower receiver 22 strikes the lower end 181 of sear member 180, sear edges 183 and 163 disengage from each other, and bowstring hook 162 rotates downward. A forwardly projecting nub 165 formed upon bowstring hook 162 temporarily engages the upper end of ADF catch 164, as shown in FIG. 15, to retard the rise of ADF catch 164 until D-loop 67 is entirely free from bowstring hook 162, and until bowstring hook 162 rises back up.

On the other hand, if no arrow is properly nocked in crossbow 20 at the time of firing, then ADF catch 164 remains in its upright position shown in FIGS. 13 and 18A. If the crossbow is inadvertently fired with no arrow present, then bowstring hook 162 will rotate downward to release D-loop 67; however, D-loop 67 will be caught by ADF catch 164, and bowstring 66 will not be released. Remedial action may then be taken to avoid danger to the user, as by re-inserting the crank arm and manually unwinding rope 88 from rope spool 120 while disengaging pawl 148.

Figure 18:
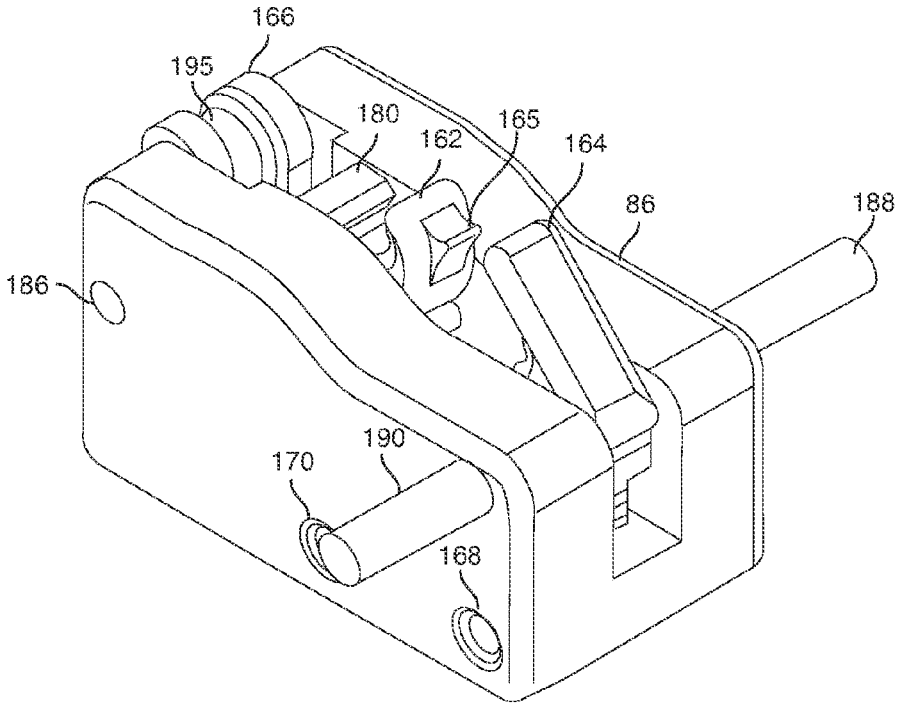
FIG. 18 is a perspective view of the bowstring release shown in FIG. 13.
Figure 18A:
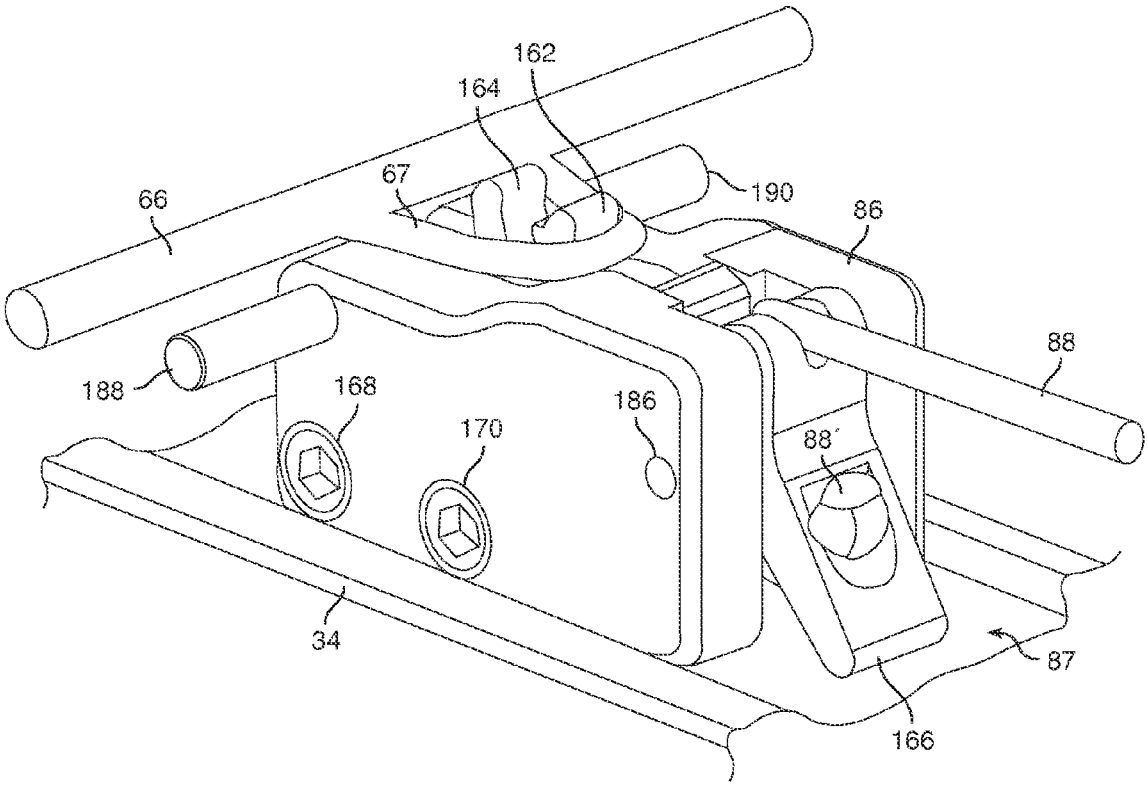
FIG. 18A is a partial perspective view of the bowstring release engaged with a D-loop attached to the bowstring in preparation for retracting the bowstring.

As shown best in FIG. 18, pins 188 and 190 extend from opposing sides of bowstring release 86. If desired, these pins 188 and 190 may actually be integral with pivot pin 174 about which ADF catch 164 pivots. Pins 188 and 190 aid in guiding bowstring release 86 into the proper fully-drawn position within upper housing 82. Pins 188 and 190 enter into cut-outs 100 and 102 (see FIGS. 4 and 5) of upper housing 82 when bowstring release 86 is fully drawn into upper housing 82 to help ensure that bowstring release 86 has been retracted into its fully drawn position.

Figure 17:
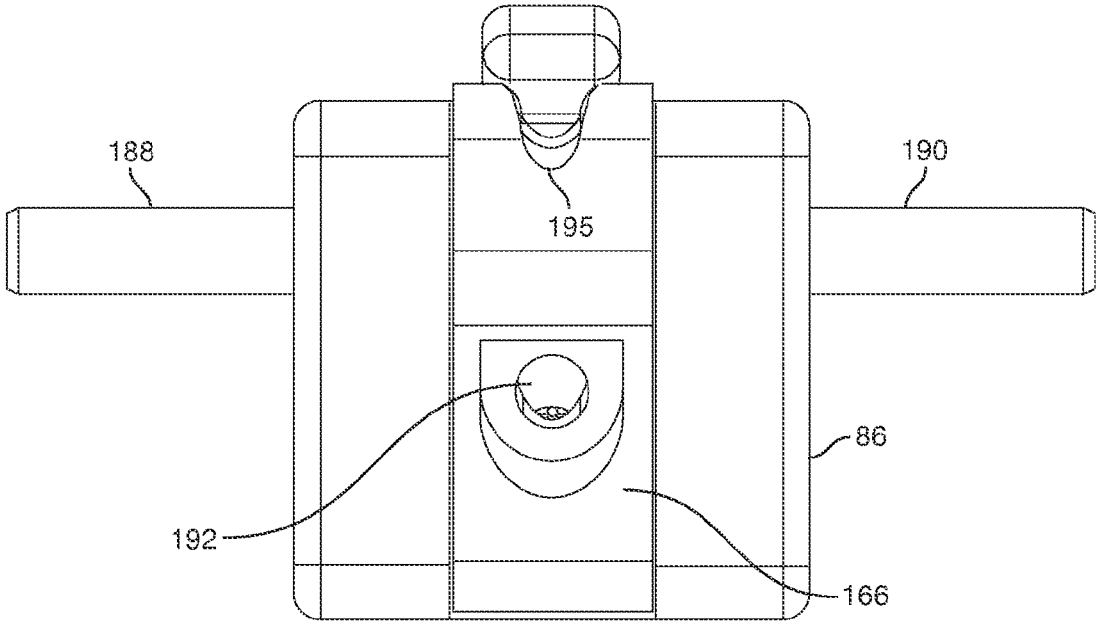
FIG. 17 is a rear view of the bowstring release shown in FIG. 13.

As mentioned earlier, hammer 169 of lower receiver 22 must be cocked before pulling trigger 26. For this reason, bowstring release 86 includes a cocking lever 166 protruding downwardly from the rear end of bowstring release 86. Referring briefly to FIGS. 17 and 18A, cocking lever 166 is designed to engage the free end of retractor rope 88. The free end of retractor rope 88 is passed over the upper end of cocking lever 166 and then through the lower end of cocking lever 166, terminating in an oversized knot 88'. Referring to FIGS. 17 and 18, the upper end of cocking lever 166 has a central channel 195 over which the free end of retractor rope 88 is passed. The free end of rope 88 is then passed down the front side of cocking lever 166 and back out through a hole 192 formed in the lower portion of cocking lever 166 before being formed into an enlarged knot 88'.

When bowstring release 86 is being retracted, rope 88 pulls the upper end of cocking ever 166 backward, forcing the lower end of cocking lever 166 into the configuration shown in FIGS. 13-16. As bowstring release 86 is retracted into upper housing 82, cocking lever 166 catches on the upper end of hammer 169 of lower receiver 22 and forces hammer 169 backward into its cocked position; cocking lever 166 ultimately passes beyond the upper end of hammer 169 as bowstring release 86 is fully retracted.

After the crossbow is fired, and the pawl release knob is operated to release rope spool 120, rope 88 becomes slack, and cocking lever 166 is free to pivot about pivot pin 186. As bowstring release 86 is withdrawn from upper housing 82, cocking lever 166 engages the upper end of hammer 169 of the lower receiver; upon such engagement, cocking lever 166 merely pivots in a counter-clockwise direction (relative to FIGS. 13-16) about pivot pin 186, whereby cocking lever is dragged over the hammer without interfering with the forward movement of bowstring release 86.

Another aspect of the present invention relates to the method of providing crossbow 20 by coupling crossbow accessory 24 to modular lower receiver 22. In practicing such method, the second end of frame member 34 is coupled to lower receiver 22, as by passing pins through attachment holes formed in second end 38 of frame member 34 which mate with attachment holes in the modular lower receiver. Bowstring 66 is retracted toward second end 38 of frame member 34 toward its drawn position, engaged with bowstring hook 162 of bowstring release 86.

The preferred method includes the step of positioning the lower end 181 of sear member 180 of bowstring release 86 proximate to hammer 169 of lower receiver 22 for being contacted by the hammer to release bowstring 66 when trigger 26 of lower receiver 22 is operated.

In the preferred embodiment, the step of retracting bowstring 66 includes the steps of engaging bowstring hook 162 with a D-loop attached to bowstring 66 before retracting bowstring 66. Bowstring release 86 is then retracted toward second end 38 of frame member 34, thereby pulling bowstring 66 away from riser 40 toward its fully-drawn position proximate second end 38 of frame member 34. The step of retracting bowstring 66 preferably includes the step of pulling bowstring release 86 into upper housing 82 proximate lower receiver 22, and positioning the actuating lever (sear member 180) proximate to hammer 169 of lower receiver 22, whereby operation of trigger 26 of lower receiver 22, and resulting rotation of hammer 169, cause bowstring release 86 to release bowstring 66 therefrom.

In practicing the novel method of the present invention, cocking lever 166 engages the upper end of hammer 169 of lower receiver 22, as bowstring release 86 is retracted, to cock the hammer. Preferably, the cocking lever 166 is pivotally secured to bowstring release 86, and one end of retractor rope 88 is secured to cocking lever 166. When the rope 88 is taut (as when bowstring 66 is being retracted), cocking lever 166 is restrained against pivotal movement. Further retraction of bowstring 66 causes cocking lever 166 of bowstring release 86 to engage hammer 169, and to rotate the hammer to its cocked position. On the other hand, after bowstring 66 is released, and rope 88 is allowed to slacken, cocking lever 166 is allowed to pivot around hammer 169 of lower receiver 22 to permit bowstring release 86 to be withdrawn from upper housing 82.

Preferably, the step of retracting bowstring 66 includes the steps of rotatably supporting spool 120 within upper housing 82, winding a first end of rope 88 about spool 120, coupling a second, opposing end of rope 88 to bowstring release 86, and rotating spool 120 to wind rope 88 around spool 120 to pull bowstring release 86, and bowstring 66, toward the drawn position. In the preferred embodiment, the step of winding the first end of rope 88 about spool 120 includes the steps of forming a rope attachment hole 134 extending transversely through spool 120, and passing an end of rope 88 through rope attachment hole 134 for securing rope 88 to spool 120.

In the preferred embodiment of the aforementioned method, a gear 124 is coupled to spool 120, and a pawl is engaged with gear 124 for permitting rotation of spool 120 in a first direction, and for selectively preventing rotation of spool 120 in a second, opposing direction.

In regard to the step of rotating the spool, the preferred form of the novel method includes the steps of coupling a gear 122 to spool 120, rotatably mounting a drive axle 138 in upper housing 82, providing spur gear 136 on drive axle 138, engaging spur gear 136 with spool gear 122, and cranking drive axle 138 to rotate spool 120 for winding rope 88 about spool 120 to retract bowstring release 86 and bowstring 66.

Use of the AR15 lower receiver trigger assembly allows crossbow 20 to fire an arrow with minimal finger pressure (i.e., trigger pull force) notwithstanding significant tension (170 pounds or more) on the bowstring. In this regard, the trigger pull force is entirely independent of the tension on the bowstring. It is only necessary that hammer 169 of the lower receiver apply sufficient force to sear member 180 to activate bowstring release 86. In addition, as explained above, cocking lever 166 on bowstring release 86 automatically cocks hammer 169 of lower receiver 22 as bowstring 66 is retracted.

When purchasing the lower receiver of the AR-15 modular rifle within the United States from one of the many manufacturers of such rifles, a purchaser must obtain a federal gun license. Those sportsman who already own an AR-15 rifle do not require an additional federal license to equip the lower receiver of their rifle with the crossbow accessory of the present invention. In addition, manufacturers of AR-15 rifles, or other weapons that include the lower receiver of an AR-15 rifle, must currently pay an 11% federal excise tax, based upon the wholesale price of the weapon, when such rifles are originally sold to distributors or retailers. On the other hand, the crossbow accessory of the present invention can be sold without payment of the current federal excise tax, as it is can be sold without the lower receiver of the AR-15 rifle to end users who already own a lower receiver of the AR-15 rifle.

The use of bowstring release 86 and flexible retractor rope 88, along with the pawl release and innovative cocking lever, allows a user to fire an arrow, retract the bowstring, and prepare to fire a second arrow, much more quickly than other crossbows. Moreover, the precise positioning of the bowstring release within the upper housing allows highly accurate shots to be consecutively fired, arrow after arrow.

Those skilled in the art will now appreciate that the present invention provides a crossbow adapted to use the trigger assembly of a conventional modular rifle in order to fire the crossbow. The use of the modular lower receiver of a rifle allows hunters already experienced in hunting with rifles to feel more comfortable hunting with a crossbow. The crossbow accessory described herein can be quickly and conveniently attached to, and detached from, the lower receiver of a modular rifle. Use of the trigger assembly of the modular lower receiver provides a crossbow wherein the trigger pull force is independent of the draw weight of the bowstring. The resulting crossbow is also relatively light in weight, very compact, and easy to operate. In addition, the crossbow accessory described herein can be manufactured and sold relatively inexpensively to current owners of modular rifles.

While the present invention has been described with respect to a preferred embodiment thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. An accessory for coupling to a modular lower receiver of a rifle to form a crossbow, the modular lower receiver having a housing, a trigger extending from the housing, and a hammer operated by the trigger, the accessory comprising in combination:

a. a riser having a central portion and opposing end portions;

b. first and second limbs coupled to the opposing end portions of the riser, the first limb extending from the riser toward a first limb tip, and the second limb extending from the riser toward a second limb tip;

c. a bowstring extending between the first limb tip and the second limb tip for propelling an arrow;

d. an elongated frame member having first and second opposing ends, the first end being coupled to the riser, and the second end being adapted for coupling with the modular lower receiver;

e. a string retractor coupled to the second end of the elongated frame member for pulling the bowstring away from the riser toward a drawn position proximate the second end of the elongated frame member; and f. a bowstring release capable of being disposed proximate the modular lower receiver, and being responsive to the hammer of the modular lower receiver for selectively releasing the bowstring when a user pulls the trigger of the modular lower receiver.

2. The accessory recited by claim 1 wherein the modular lower receiver includes attachment holes to facilitate coupling of the modular lower receiver to other components, and wherein the second end of the elongated frame member includes attachment holes which mate with the attachment holes in the modular lower receiver for receiving fastening pins to couple the second end of the elongated frame member to the modular lower receiver.

3. The accessory recited by claim 1 wherein the string retractor includes:

a. an upper housing coupled to the second end of the elongated frame member;

b. a spool rotatably supported within the upper housing;

c. a rope having first and second opposing ends, the first end of the rope being attached to the spool, and the second end of the rope being selectively coupled to the bowstring to retract the bowstring toward a drawn position; and d. means for rotating the spool to wind the rope around the spool to pull the bowstring toward the drawn position.

4. The accessory recited by claim 3 wherein the spool includes a first gear, and wherein the means for rotating the spool includes:

a. a spur gear engaged with the first gear of the spool;

b. a drive axle coupled to the spur gear; and c. a winding crank for rotating the drive axle;

wherein operation of the winding crank rotates the drive axle and spur gear, which rotates the spool.

5. The accessory recited by claim 4 wherein the spool includes a second gear, the first and second gears being on opposing sides of the spool, and wherein the means for rotating the spool further includes a pawl engaged with the second gear of the spool for permitting rotation of the spool in a first direction, and for selectively preventing rotation of the spool in a second, opposing direction.

6. The accessory recited by claim 3 wherein the spool has a hole formed transversely therethrough for receiving the first end of the rope.

7. The accessory recited by claim 1 wherein the accessory is adapted to be coupled to the modular lower receiver of an AR-15 rifle.

8. The accessory recited by claim 1 wherein:

a. the string retractor includes an upper housing coupled to the second end of the elongated frame member, a spool rotatably supported within the upper housing, and a rope having a first end attached to the spool and a second opposing end coupled to the bowstring release;

b. the bowstring release includes a bowstring hook for selectively engaging the bowstring, and an actuating lever for releasing the bowstring hook; and c. the string retractor is operative to pull the bowstring release into the upper housing proximate the modular lower receiver wherein the actuating lever of the bowstring release is disposed proximate to the hammer of the modular lower receiver, and being responsive to the hammer of the modular lower receiver for selectively releasing the bowstring when a user pulls the trigger of the modular lower receiver.

9. The accessory recited by claim 8 wherein the elongated frame member includes a channel formed therein extending from at least the bowstring to the upper housing for receiving the bowstring release, and for guiding the bowstring release upon the elongated frame member as the bowstring release is retracted into the upper housing.

10. The accessory recited by claim 8 wherein the bowstring release includes a cocking bar for cocking the hammer of the modular lower receiver as the bowstring release is retracted into the upper housing.

11. The accessory recited by claim 10 wherein the spool includes a gear, and wherein the string retractor further includes a pawl selectively engaged with the gear of the spool for permitting rotation of the spool in a first direction, and for selectively preventing rotation of the spool in a second, opposing direction, the string retractor further including a pawl release member for disengaging the pawl from the gear.

12. The accessory recited by claim 11 wherein the cocking bar is pivotally mounted to the bowstring release, wherein the cocking bar is prevented from pivoting when the rope of the string retractor is being retracted, and wherein the cocking bar is permitted to pivot after the pawl is released, whereby the cocking lever avoids interference with the hammer of the modular lower receiver when the bowstring release is pulled away from the upper housing.

13. The accessory recited by claim 11 wherein the cocking bar is pivotally mounted to the bowstring release, wherein the second end of the rope engages the cocking bar to prevent the cocking bar from pivoting when the rope is taut, and wherein the cocking bar is permitted to pivot when the rope is slack, whereby the cocking lever cocks the hammer of the modular lower receiver as the bowstring is retracted, while the cocking lever avoids interference with the hammer of the modular lower receiver when the rope is slack and the bowstring release is pulled away from the upper housing.

14. A method of providing a crossbow using a modular lower receiver of a rifle, the modular lower receiver having a housing, a trigger extending from the housing, and a hammer operated by the trigger, the method comprising the steps of:

a. providing an accessory, the accessory including:

I. a riser having a central portion and opposing end portions;

ii. first and second limbs coupled to the opposing end portions of the riser, the first limb extending from the riser toward a first limb tip, and the second limb extending from the riser toward a second limb tip;

iii. a bowstring extending between the limb tips of the first and second limbs for propelling an arrow;

iv. an elongated frame member having first and second opposing ends, the first end being coupled to the riser;

v. a bowstring release capable of being disposed proximate the second end of the elongated frame member, the bowstring release including a bowstring hook for selectively engaging the bowstring, and an actuating lever for releasing the bowstring hook;

b. fastening the second end of the elongated frame member to the modular lower receiver;

c. retracting the bowstring toward the second end of the elongated frame member for pulling the bowstring away from the riser toward a drawn position proximate the second end of the elongated frame member, the bowstring being engaged with the bowstring hook of the bowstring release when the bowstring is in its drawn position; and d. positioning the actuating lever of the bowstring release proximate to the hammer of the modular lower receiver for being contacted thereby when the trigger of the modular lower receiver is operated.

15. The method of claim 14 wherein the retracting step includes the steps of:

a. engaging the bowstring hook of the bowstring release with the bowstring before retracting the bowstring toward the second end of the elongated frame member; and b. retracting the bowstring release toward the second end of the elongated frame member for pulling the bowstring away from the riser toward its drawn position proximate the second end of the elongated frame member.

16. The method of claim 15 including the step of providing an upper housing proximate the second end of the elongated frame member.

17. The method of claim 16 wherein the retracting step includes the steps of:

a. rotatably supporting a spool within the upper housing;

b. winding the first end of a rope about the spool;

c. coupling a second, opposing end of the rope to the bowstring release; and d. rotating the spool to wind the rope around the spool to pull the bowstring release, and the bowstring, toward the drawn position.

18. The method of claim 17 including the steps of:

a. coupling at least one gear to the spool; and b. engaging a pawl with the at least one gear for permitting rotation of the spool in a first direction, and for selectively preventing rotation of the spool in a second, opposing direction.

19. The method of claim 17 including the steps of:

a. forming a rope attachment hole extending transversely through the spool; and b. passing the first end of the rope through the rope attachment hole for securing the first end of the rope to the spool.

20. The method of claim 17 wherein the step of rotating the spool includes the steps of:

a. coupling a first gear to the spool;

b. rotatably mounting a drive axle in the upper housing;

c. providing a spur gear on the drive axle;

d. engaging the spur gear with the first gear of the spool; and e. cranking the drive axle to rotate the spool and to wind the rope about the spool to retract the bowstring release and the bowstring.

21. The method of claim 16 wherein the retracting step includes the step of pulling the bowstring release into the upper housing proximate the modular lower receiver wherein the actuating lever of the bowstring release is disposed proximate to the hammer of the modular lower receiver.

22. The method of claim 21 including the steps of:

a. securing a cocking bar to the bowstring release; and b. cocking the hammer of the modular lower receiver by engaging the cocking bar with the hammer of the modular lower receiver as the bowstring release is retracted into the upper housing.

23. The method of claim 22 including the step of pivotally securing the cocking bar to the bowstring release, and securing the second end of the rope to the cocking bar for preventing pivotal movement of the cocking bar when the bowstring release is being retracted.

24. The method of claim 23 including the step of allowing the cocking bar to pivot around the hammer of the modular lower receiver when tension is released from the rope to permit the bowstring release to be withdrawn from the upper housing.

25. The method of claim 14 wherein the modular lower receiver includes attachment holes to facilitate coupling of the modular lower receiver to other components, and wherein the second end of the elongated frame member includes attachment holes which mate with the attachment holes in the modular lower receiver, and wherein the step of fastening the second end of the elongated frame member to the modular lower receiver includes the step of inserting fastening pins through mating attachment holes in the modular lower receiver and in the second end of the elongated frame member to couple the second end of the elongated frame member to the modular lower receiver.

* * * * *